US005927811A

United States Patent [19]

Tseng

[11] Patent Number: 5,927,811

[45] Date of Patent: Jul. 27, 1999

[54] ADJUSTABLE CHAIR-ARMREST ASSEMBLY

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 09/032,540

[22] Filed: Feb. 27, 1998

[51] Int. Cl.[6] ..... A47C 7/54; B60N 2/46

[52] U.S. Cl. ..... 297/353; 297/411.31; 297/411.35; 297/411.37

[58] Field of Search ..... 297/411.35, 411.37, 297/411.38, 411.31, 411.33, 411.34, 353

[56] References Cited

U.S. PATENT DOCUMENTS

| | | | |
|---|---|---|---|
| 5,380,065 | 1/1995 | Rohrer | 297/411.35 X |
| 5,393,124 | 2/1995 | Neil | 297/411.35 |
| 5,407,249 | 4/1995 | Bonutti | 297/411.35 |
| 5,439,268 | 8/1995 | Dozsa-Farkas | 297/411.35 |
| 5,484,187 | 1/1996 | Doerner et al. | 297/411.35 X |
| 5,590,934 | 1/1997 | Gibbs | 297/411.35 X |
| 5,641,283 | 6/1997 | Van De Riet et al. | 297/411.37 |
| 5,651,586 | 7/1997 | Groth | 297/411.37 |
| 5,655,814 | 8/1997 | Gibbs | 297/411.37 X |
| 5,749,628 | 5/1998 | Synder et al. | 297/411.31 X |

*Primary Examiner*—Peter M. Cuomo
*Assistant Examiner*—Rodney B. White
*Attorney, Agent, or Firm*—Ladas & Parry

[57] ABSTRACT

An adjustable armrest assembly includes an elongated connector and an armrest member which has a top armrest wall and two substantially parallel rail members on two opposite sides of the top armrest wall to slidably engage the elongated connector. A locking mechanism has a dog member which is connected to the rail members and which is engagable with the elongated connector for locking the armrest member against movement relative to the elongated connector after the armrest member is moved to a desired position relative to the elongated connector. A base is adapted to be fixed to a chair, and has a rotary shaft mounted thereon. A rotary seat is mounted rotatably on the rotary shaft and is connected to the elongated connector. A resilient engaging member resiliently protrudes upward from the base to selectively engage holes of the rotary seat for adjustably holding the rotary seat at a selected angular position relative to the base.

5 Claims, 5 Drawing Sheets

ADJUSTABLE CHAIR-ARMREST ASSEMBLY

BACKGROUND OF THE INVENTION

1.Field of the Invention

This invention relates to a chair armrest assembly, more particularly to an adjustable chair armrest assembly in which the orientation and horizontal position of an armrest member can be adjusted.

2. Description of the Related Art

Referring to FIG. 1, a conventional armchair includes two armrest supports 12 secured to two sides of a chair frame, and two armrest members 11 mounted respectively on top ends of the supports 12. The armrest members 11 can be moved in a vertical direction by means of two control units 13 for adjusting their height. However, consumers, especially computer operators, are more and more fastidious about convenience in the use of their chairs. There is a need to rotate an armrest about a horizontal axis and a vertical axis on the chair seat in order to adjust the orientation and horizontal position of the armrest.

SUMMARY OF THE INVENTION

The main object of the present invention is to provide an adjustable armrest assembly in which the horizontal position of an armrest member can be adjusted.

Another object of the present invention is to provide an adjustable armrest assembly in which the orientation of the armrest member can be adjusted.

According to this invention, an adjustable armrest assembly includes an elongated connector, and an armrest member which has a top armrest wall and two substantially parallel rail members on two opposite sides of the top armrest wall to slidably engage the elongated connector. A locking mechanism has a dog member which is connected to the rail members and which is engagable with the elongated connector for locking the armrest member against movement relative to the elongated connector after the armrest member is moved to a desired position relative to the elongated connector. In addition, a base is adapted to be fixed to the chair, and has a rotary shaft mounted thereon. A rotary seat is mounted rotatably on the rotary shaft and is connected to the elongated connector. The rotary seat has a plurality of holes angularly spaced about the rotary shaft. A resilient engaging member resiliently protrudes upward from the base to selectively engage the holes for adjustably holding the rotary seat at a selected angular position relative to the base.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
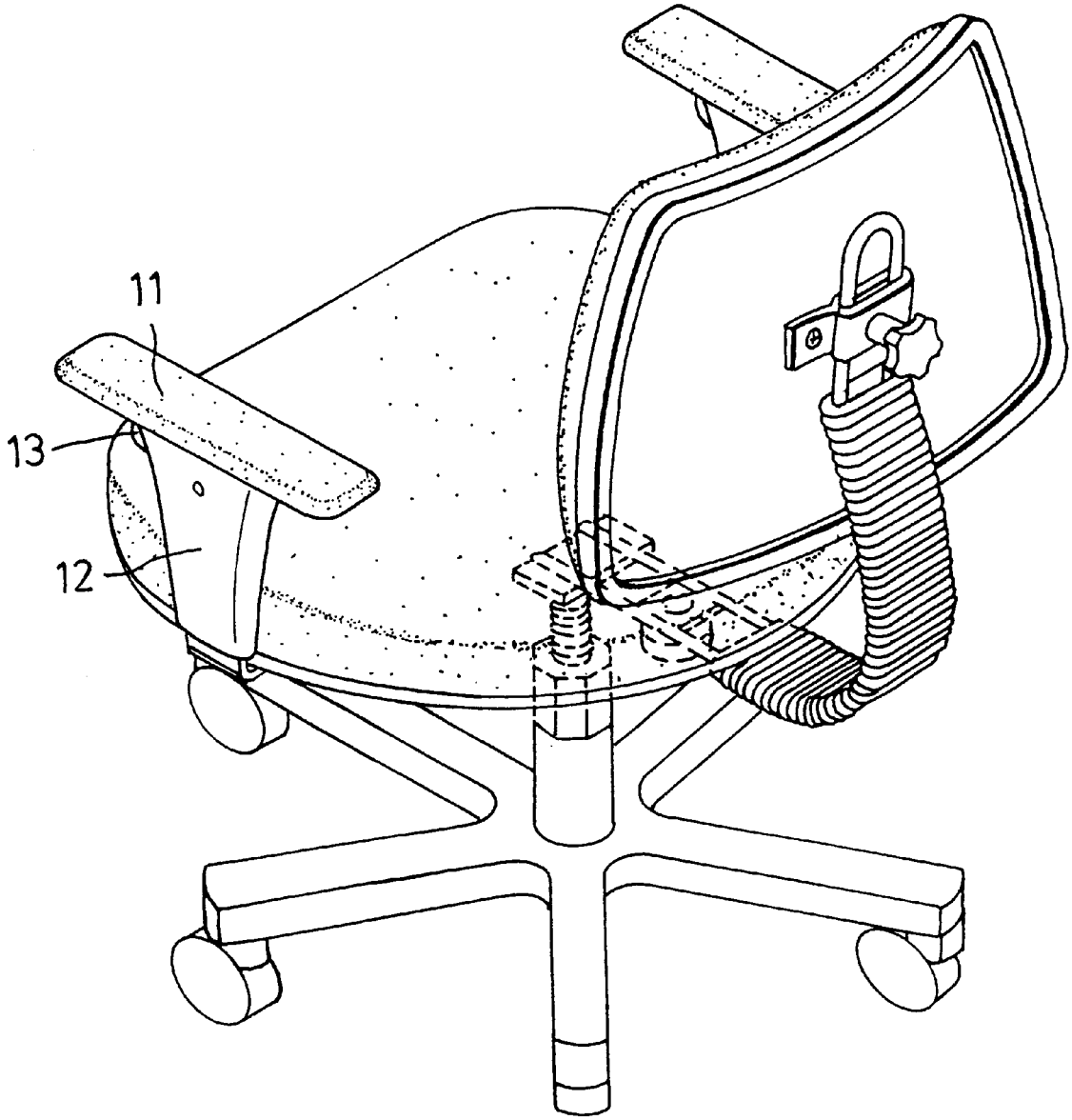
FIG.1 PRIOR ART
FIG. 1 is a perspective view of a conventional armchair.
Figure 2:
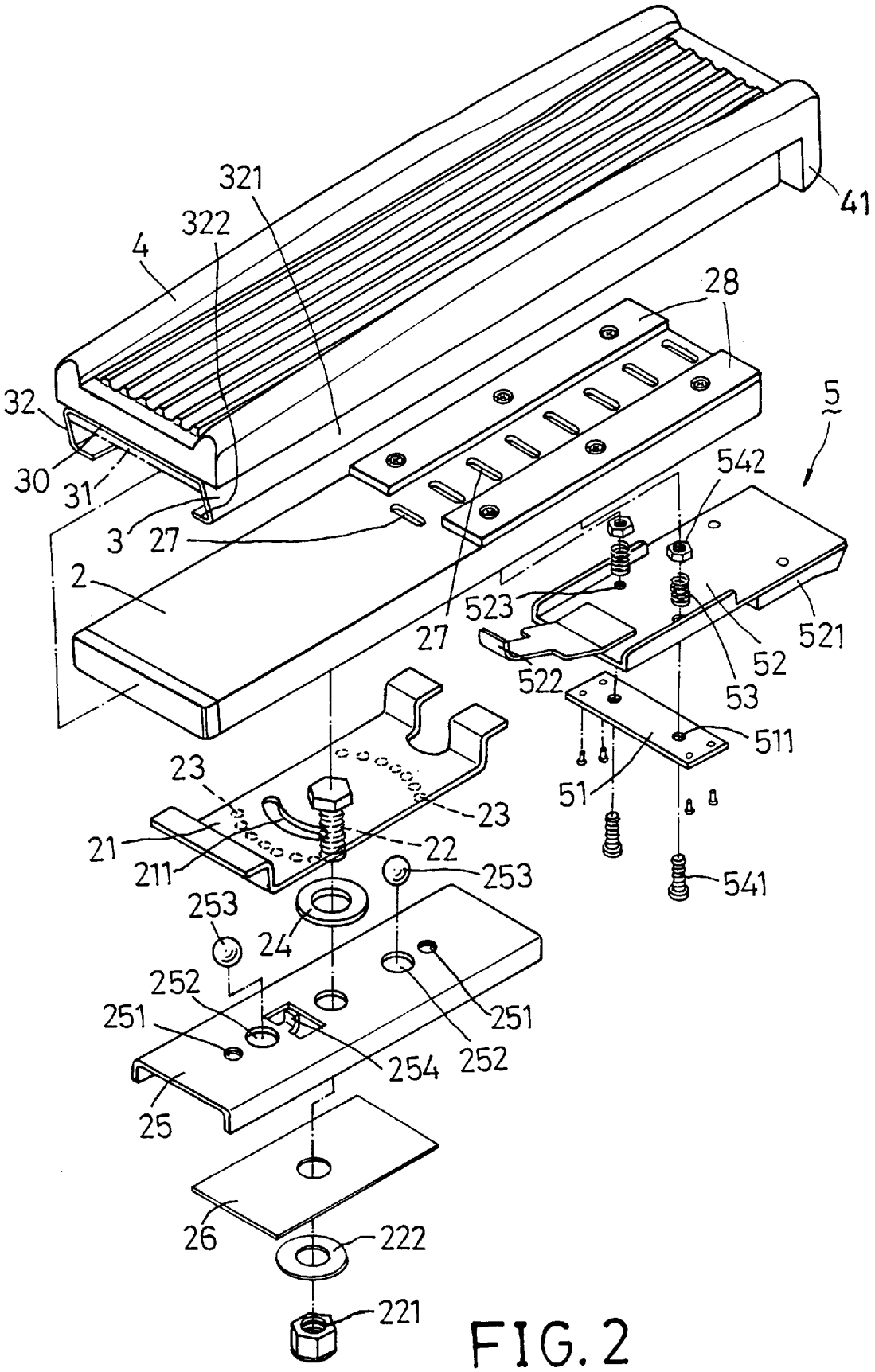
FIG. 2 is an exploded view of a preferred embodiment of an adjustable armrest assembly according to this invention.
Figure 3:
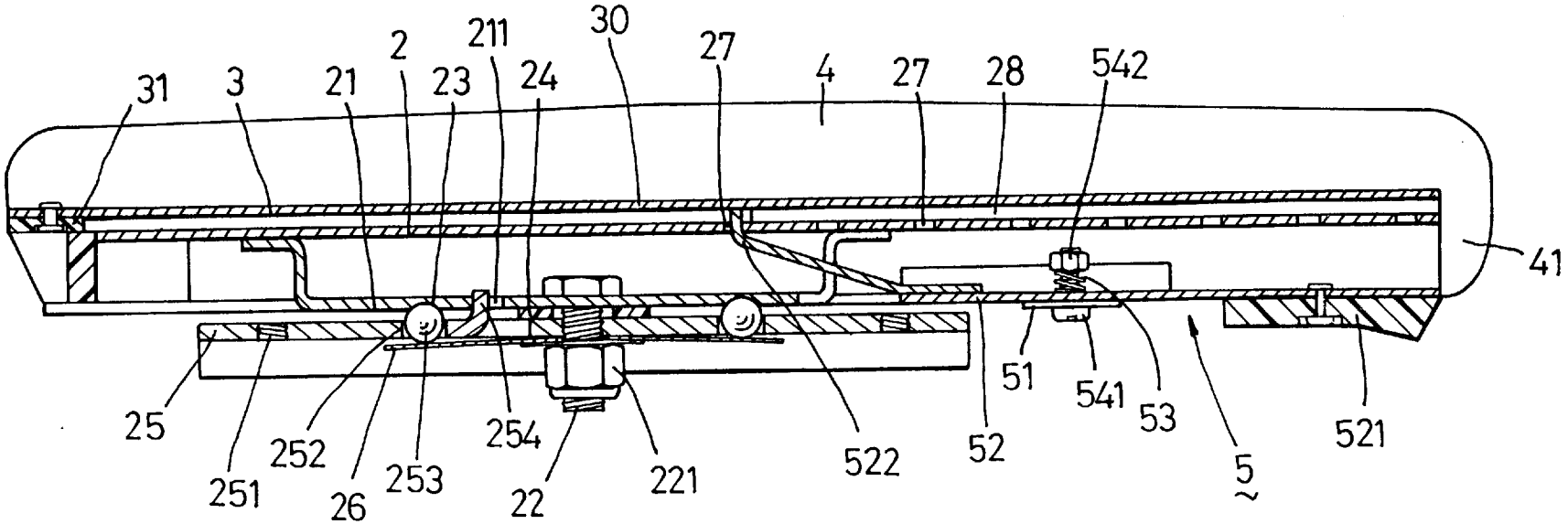
FIG. 3 is a sectional view showing the armrest assembly of the preferred embodiment in a locked position.

Referring to FIGS. 2 and 3, a preferred embodiment of an adjustable armrest assembly according to the present invention is shown to comprise an elongated connector 2, an armrest member 3, and an armrest pad 4 secured on the armrest member 3 for supporting one of the arms of the user.

The elongated connector 2 has a plurality of locking holes 27 at a front portion. A longitudinal limiting member 28 projects upward from the front portion of the elongated connector 2 on two sides of the locking holes 27.

In addition, the elongated connector 2 has a rotary seat 21 which is secured thereto at a rear portion of the connector 2. The rotary seat 21 is mounted rotatably on a rotary shaft 22, such as a screw bolt, and has a plurality of small holes 23 which are angularly spaced about the rotary shaft 22, and an arcuate guiding slot 211 which is radially spaced from and extends inwardly of the small holes 23. A washer 24, a base 25 and a resilient plate 26 are secured to the rotary shaft 22 below the rotary seat 21 by means of a washer 222 and a screw nut 221. The base 25 has two threaded holes 251 for use in fastening the base 25 to an armrest support of a chair frame (not shown). Resilient engaging members are provided on the base 25 and include two balls 253 which are received respectively in through holes 252. The resilient plate 26 is disposed below the base 25, and has two end portions extending beneath the through holes 252 so as to resiliently push the balls 253 to protrude upward partially. The balls 253 selectively engage the small holes 23 after the angular position of the rotary seat 21 is adjusted relative to the base 25. Moreover, the base 25 further has a guiding tongue 254 to extend and slide into the guiding slot 211 for guiding the rotary movement of the rotary seat 21.

The armrest member 3 is telescopically disposed on the elongated connector 2, and has two rail members 32 which are disposed on two opposite sides of a top armrest wall 30 so as to slidably engage the elongated connector 2. Each rail member 32 includes a vertical plate portion 321 which extends downwardly from the top armrest wall 30, and a horizontal plate portion 322 which extends from a lower end of the vertical plate portion 321 toward the other vertical plate portion 321. The top armrest wall 30 has front and rear ends with downwardly extending transverse first and second limiting members 41, 31 so as to limit the limiting member 28 to move only between the first and second limiting members 41, 31.

A locking mechanism includes a dog member 5 which is connected to the rail members 32 and which is engagable with the elongated connector 2 for locking the armrest member 3 against movement relative to the elongated connector 2. The dog member 5 includes a bridge 51 which is fixed to the horizontal plate portions 322 of the rail members 32 and which has two engaging holes 511, and a lever plate 52 which is fulcrumed at the bridge 51. The lever plate 52 has an upward hook 522 at a rear end thereof for hooking selectively one of the locking holes 27, two engaging holes 523 at an intermediate portion thereof, and a press portion 521 which is formed at a bottom of a front end of the lever plate 52. Two springs 53 are mounted on the lever plate 52 at the engaging holes 523 for biasing the rear end of the lever plate 52 to move upward to cause the upward hook 522 to engage one of the locking holes 27, and two threaded bolts 541 pass respectively through the corresponding engaging holes 511, 523 of the bridge 51 and the lever plate 52, the springs 53, and two screw nuts 542. The springs 53 are mounted between the lever plate 52 and the screw nuts 542.

Figure 4:
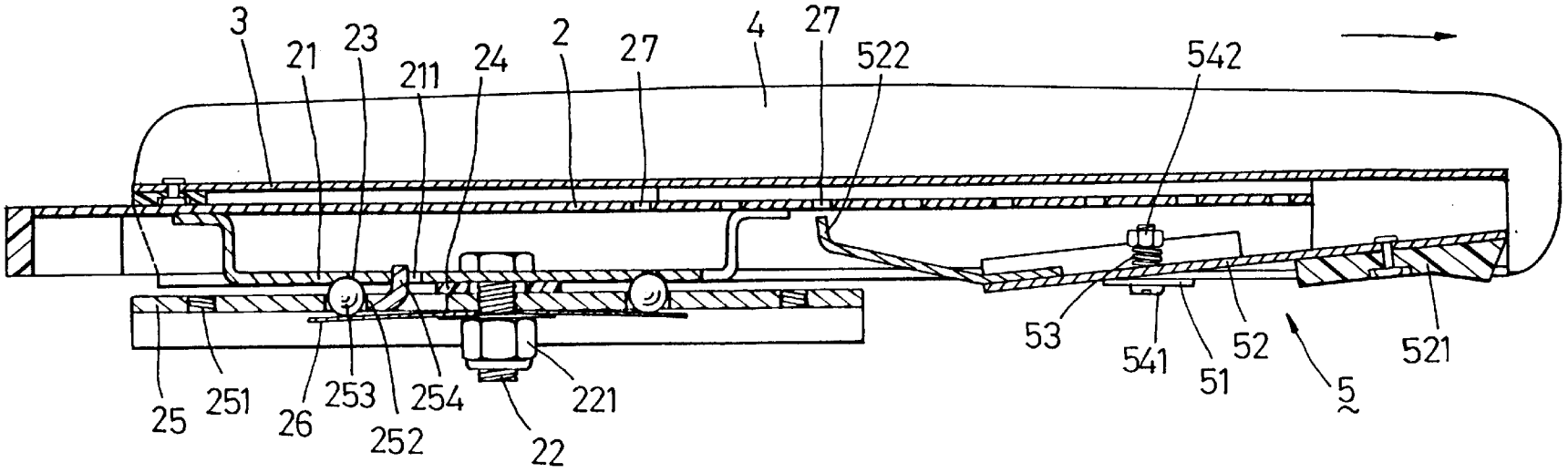
FIG. 4 is a sectional view showing the armrest assembly in an unlocked position.

When the upward hook 522 of the lever plate 52 engages one of the locking holes 27 of the elongated connector 2, as shown in FIG. 3, the armrest member 3 cannot slide along the elongated connector 2. When it is desired to move the armrest member 3 forward, one merely places his hand on the armrest pad 4 to push the press portion 521 upward. Referring to FIG. 4, the upward hook 522 is thus moved downward to separate from the locking hole 27, thus permitting the forward sliding movement of the armrest member 3 relative to the elongated connector 2. At this time, the springs 53 are compressed by the lever plate 52 at the side adjacent to the press portion 521. When the user releases the armrest member 3 after the latter is moved to a predetermined position relative to the elongated connector 2, the upward hook 522 automatically moves upward by means of the springs 53 to engage another locking hole 27.

Figure 5:
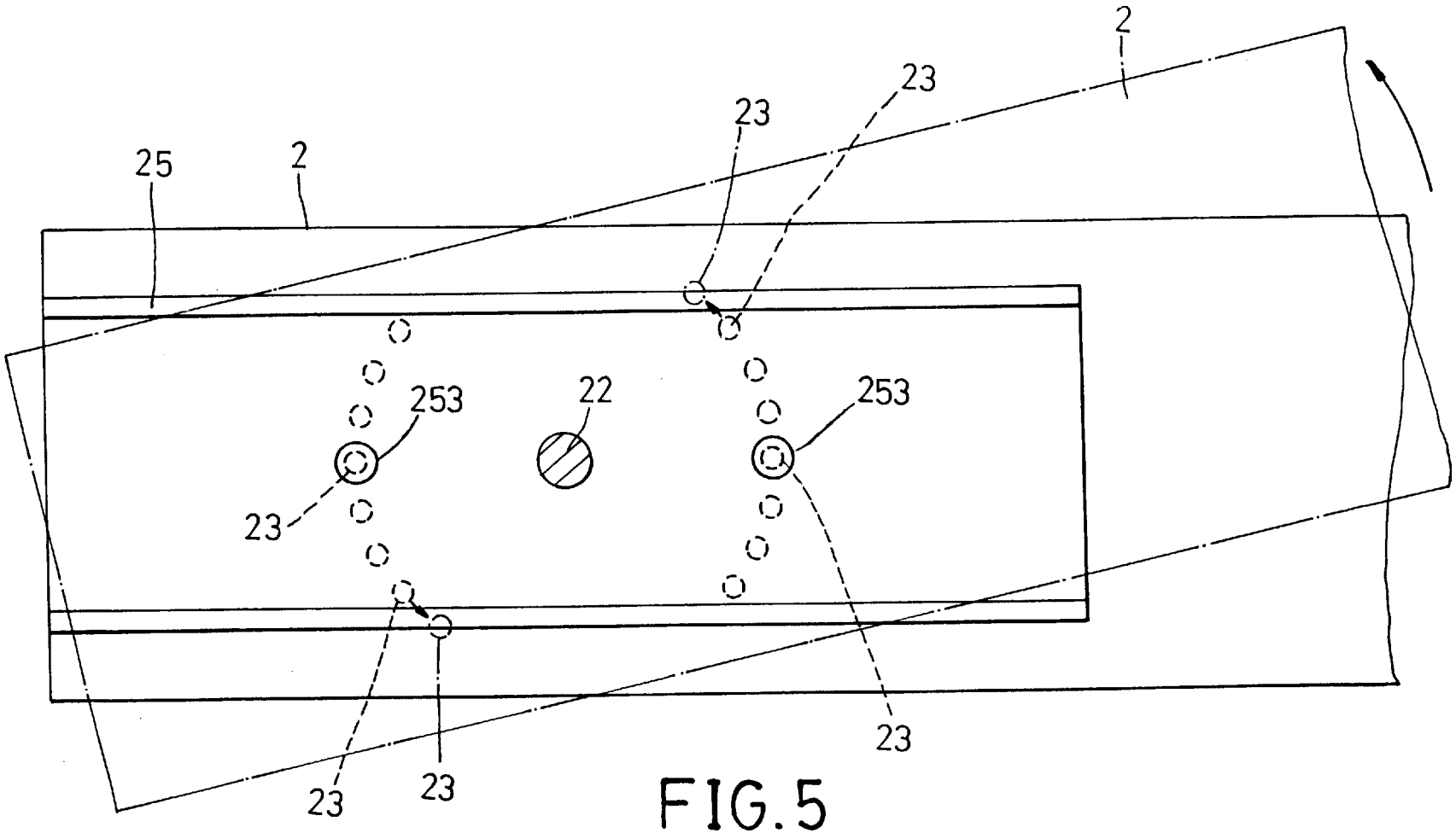
FIG. 5 is a bottom view showing how an elongated connector of the armrest assembly is rotated about a rotary shaft.

Referring again to FIG. 2, when it is desired to adjust the orientation of the armrest assembly, the elongated connector 2, the armrest member 3 and the armrest pad 4 are forced against the biasing force of the resilient plate 26 so that they can rotate about the rotary shaft 22. As shown in FIG. 5, the balls 253 protrude partially into a pair of the small holes 23 by means of the biasing force of the resilient plate 26, thereby holding the pad 4 and the armrest member 3 in position.

As mentioned above, the chair-armrest assembly of this invention can accomplish two specific adjustments. First, the chair-armrest assembly is adjustable forward and backward so as to accommodate different working distances between the chair upon which the armrest assembly is mounted and the working table. Second, the chair-armrest assembly is adjustable in its orientation so as to accommodate differences in the distance between two hands of different users. In addition, the chair-armrest assembly of this invention can be mounted on a height-adjustable armrest support of a chair so as to achieve a multiple adjusting effect.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An adjustable armrest assembly for a chair, comprising:

an elongated connector having a rear portion and a front portion;

an armrest member telescopically disposed on said elongated connector and having a top armrest wall and two substantially parallel rail members which are disposed on two opposite sides of and below said top armrest wall to slidably engage said elongated connector; and a locking mechanism for locking said armrest member against movement relative to said elongated connector, said locking mechanism having a dog member which is connected to said rail members and which is engagable with said elongated connector, wherein each of said rail members includes a vertical plate portion extending downwardly from said top armrest wall, and a horizontal plate portion extending from a lower end of said vertical plate portion toward said vertical plate portion of the other one of said rail members, said elongated connector having a plurality of locking holes at said front portion of said elongated connector, said dog member including a bridge which is fixed to said horizontal plate portions of said rail members, a lever plate which is fulcrumed at said bridge and which has a rear end formed with an upward hook for engaging selectively one of said locking holes, spring means for biasing said rear end of said lever plate to move upward to cause said upward hook to engage one of said locking holes, and a front end formed with a press portion manually operable to move said upward hook away from said locking holes.

2. The adjustable armrest assembly as claimed in claim 1, wherein said elongated connector has a longitudinal limiting member which projects upward from said front end portion on two sides of said locking holes, said top armrest wall having front and rear ends with downwardly extending transverse limiting members which project downward therefrom to limit said longitudinal limiting member to move only between said transverse limiting members.

3. The adjustable armrest assembly as claimed in claim 2, further comprising:

a base which is adapted to be fixed to the chair and which has a rotary shaft mounted thereon;

a rotary seat mounted rotatably on said rotary shaft and connected to said elongated connector, said rotary seat having a plurality of holes angularly spaced about said rotary shaft; and a resilient engaging member resiliently protruding upward from said base to selectively engage said holes for adjustably holding said rotary seat at a selected angular position relative to said base.

4. The adjustable armrest assembly as claimed in claim 3, wherein said resilient engaging member includes a through hole which is formed in said base, a ball received in said through hole, and a resilient plate which is disposed below said base at said through hole to resiliently push said ball to protrude upward partially.

5. The adjustable armrest assembly as claimed in claim 4, further comprising an arcuate guiding slot formed in said rotary seat, said guiding slot being radially spaced from and extending inwardly of said holes, and a guiding tongue provided on said base to extend and slide into said guiding slot for guiding rotary movement of said rotary seat.

* * * * *